US006666448B2

(12) United States Patent
Sato et al.

(10) Patent No.: US 6,666,448 B2
(45) Date of Patent: Dec. 23, 2003

(54) APPARATUS HANDLING PAPER SHEETS AND THE LIKE

(75) Inventors: Goro Sato, Chiyoda (JP); Hisahiro Koshizuka, Owariasahi (JP); Shinji Shibata, Nagoya (JP); Riichi Kato, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/012,404

(22) Filed: Dec. 12, 2001

(65) Prior Publication Data

US 2002/0096821 A1 Jul. 25, 2002

(30) Foreign Application Priority Data

Jan. 19, 2001 (JP) ..... 2001-010981

(51) Int. Cl.[7] ..... B65H 29/38
(52) U.S. Cl. ..... 271/177; 271/178
(58) Field of Search ..... 271/178, 177

(56) References Cited

U.S. PATENT DOCUMENTS 2,844,373 A * 7/1958 Van Marle ..... 271/178
3,166,313 A * 1/1965 Rehm ..... 271/178
4,052,053 A * 10/1977 Hasegawa et al. ..... 271/187
4,245,833 A * 1/1981 Akerstrom ..... 271/198
4,363,584 A * 12/1982 Kokubo ..... 414/788.5
4,750,728 A * 6/1988 Keller ..... 271/161
4,828,243 A * 5/1989 Ebihara ..... 271/315
4,915,371 A * 4/1990 Quinton ..... 271/280
5,171,008 A * 12/1992 Zimmermann ..... 271/178
5,201,504 A * 4/1993 Fallos et al. ..... 271/2
5,485,989 A * 1/1996 McCay et al. ..... 271/2
6,065,746 A * 5/2000 Tranquilla ..... 271/176

FOREIGN PATENT DOCUMENTS

JP A-05-298524 11/1993
JP A-2000-72311 3/2000

* cited by examiner

*Primary Examiner*—Donald P. Walsh
*Assistant Examiner*—Kaitlin Joerger
(74) *Attorney, Agent, or Firm*—Antonelli, Terry, Stout & Kraus, LLP

(57) ABSTRACT

When a large number of paper sheets and the like, tending to be folded or curled, are introduced into an introducing space, folded portions of the paper sheets and the like or edges of the curled paper sheets and the like project into an introducing port, so that the paper sheets and the like interfere with each other, thereby causing troubles such as the folding of the edge portions of the paper sheets and the like and the residence of the paper sheets and the like. Therefore, a gripping device is provided in the vicinity of a paper sheets and the like introducing port of a paper sheets and the like introducing mechanism, and this gripping device includes a plurality of brush portions which grip the paper sheets and the like to be introduced into a receiving cassette, and feeds the paper sheets and the like to a paper sheets and the like introducing portion, and the brush portions grip the paper sheets and the like in an upstanding posture in the paper sheets and the like introducing portion.

10 Claims, 6 Drawing Sheets

APPARATUS HANDLING PAPER SHEETS AND THE LIKE

BACKGROUND OF THE INVENTION

This invention relates to an apparatus for handling paper sheets and the like.

A conventional apparatus for handling paper sheets and the like is disclosed in JP-A-2000-72311.

A paper sheets and the like receiving cassette of this apparatus for handling paper sheets and the like includes a paper sheets and the like introducing mechanism for introducing paper sheets and the like, a paper sheets and the like introducing space for stacking the paper sheets and the like introduced by the paper sheets and the like introducing mechanism, a paper sheets and the like receiving space for storing the paper sheets and the like stacked in the paper sheets and the like introducing space, a paper sheets and the like receiving mechanism for bringing the paper sheets and the like from the introducing space into the receiving space, and a movable partition member for separating the paper sheets and the like introducing space from the receiving space.

The paper sheets and the like are upwardly fed one by one between guides and elastic components by the paper sheets and the like introducing mechanism, and are introduced into the paper sheets and the like introducing space from the lower side thereof, and are temporarily stopped there. Thereafter, the elastic components rotates to push the paper sheets and the like toward the receiving space, and the paper sheets and the like are introduced in an upstanding condition, with their lower edges arranged neatly on a bottom surface guide, and the bills (paper sheets and the like) are not restricted. When the introducing operation is finished, the bills in the introducing space are stored into the receiving space by the receiving mechanism.

In the above conventional technique, there are occasions when the number of paper sheets and the like, which can be introduced, is limited.

For example, when paper sheets and the like, tending to be folded (particularly those having a fold directed toward a bill introducing port and paper sheets and the like, tending to be curled), are introduced in a large amount, the folded portion or the curled portion of the paper sheets and the like projects from the introducing space into an introducing transfer path, and interferes with the subsequent paper sheets and the like, so that an edge portion of the paper sheets and the like is folded, and when the number of such projecting paper sheets and the like increases, the paper sheets and the like to be subsequently introduced, in some cases, tend to jam in the vicinity of the introducing port.

In the case of providing components for preventing a fold and a curl in order to overcome this problem, such fold or curl rises at different positions when the paper sheets and the like to be introduced have different sizes, and the number of the positions, at which these prevention members are provided, increases, and the mechanism becomes complicated, and the production cost increases. And besides, there may be used paper sheets and the like of such a size that a fold or a curl thereof can not be prevented by the prevention member.

SUMMARY OF THE INVENTION

It is therefore an object of this invention to provide an apparatus for handling paper sheets and the like in which even when paper sheets and the like of different sizes, as well as paper sheets and the like tending to be folded or curled, are introduced in a large amount into the apparatus for handling paper sheets and the like, these paper sheets and the like can be positively stored in an upstanding condition in a limited small space, that is, in a receiving cassette or an inlet/outlet port, and the receiving cassette or the inlet/outlet port is highly-reliable and inexpensive, and is less liable to troubles such as jam of the paper sheets and the like.

According to the present invention, there is provided an apparatus for handling paper sheets and the like comprising a paper sheets and the like inlet/outlet port through which paper sheets and the like are put into and out of the apparatus, a discrimination portion for discriminating between the paper sheets and the like, a receiving cassette for storing the paper sheets and the like, and a transfer path interconnecting the paper sheets and the like inlet/outlet port, the discrimination portion and the receiving cassette so as to transfer the paper sheets and the like. In the present invention, the receiving cassette comprises introducing means for introducing the paper sheets and the like into the receiving cassette from a lower side thereof, a paper sheets and the like introducing space for temporarily gripping and stacking the paper sheets and the like in an upstanding posture, and push means for pushing the paper sheets and the like, introduced by the introducing means, into the paper sheets and the like introducing space.

With this construction, the paper sheets and the like, pushed into the paper sheets and the like introducing space, can be gripped in an upstanding posture even if these paper sheets and the like tend to be folded or curled, and the folding or curling of the paper sheets and the like can be prevented, and a larger number of paper sheets and the like (bills) can be introduced into a limited space.

There is provided gripping means for gripping lower portions of the paper sheets and the like stacked in an upstanding posture in the paper sheets and the like introducing space. With this construction, the lower edges of the paper sheets and the like are prevented from projecting into the paper sheets and the like introducing port, and therefore are prevented from interfering with a subsequent paper sheets and the like.

The receiving cassette includes a receiving space for storing the paper sheets and the like, disposed in the paper sheets and the like introducing space, in a stacked manner, push means for pushing the paper sheets and the like, stored in the paper sheets and the like introducing space, into the receiving space, and partition means for preventing the paper sheets and the like, stored in the receiving space, from interfering with the paper sheets and the like stored in the paper sheets and the like introducing space.

The receiving cassette includes a paper sheets and the like introducing mechanism for introducing paper sheets and the like into the receiving cassette from the exterior thereof, a paper sheets and the like introducing space for temporarily stacking the paper sheets and the like introduced by the paper sheets and the like introducing mechanism, and a receiving space for storing the paper sheets and the like introduced into the receiving cassette. The paper sheets and the like introducing mechanism comprises rollers, which are provided in the vicinity of a paper sheets and the like introducing port of the receiving cassette, and grip the paper sheets and the like to introduce the same into the receiving cassette from the lower side thereof, and brush rollers which can be rotated about an axis, on which those of the rollers, provided in the paper sheets and the like introducing space, are disposed, and have a plurality of radially-extending brush portions (circumferentially spaced from one another at equal intervals) which hold the paper sheets and the like, brought out of gripping engagement with the rollers, and introduced into the paper sheets and the like introducing space, in an upstanding posture, and partition means, provided in the paper sheets and the like introducing space, can be moved away from the brush rollers, and have an upper end portion slanting toward the brush rollers, and when the brush rollers are rotated, the brush portions are brought into contact with a lower end portion of the partition means to grip the paper sheets and the like, temporarily stacked in the paper sheets and the like introducing space, in an upstanding posture in such a manner that the paper sheets and the like are held in intimate contact with the slanting surface of the partition means.

With this construction, the lower edges of the paper sheets and the like, temporarily stacked in the paper sheets and the like introducing space, are effectively prevented from interfering with the subsequent paper sheets and the like.

There is provided projection prevention means for preventing the lower edges of the paper sheets and the like, stacked in an upstanding posture in the paper sheets and the like introducing space, from projecting into the paper sheets and the like introducing port of the receiving cassette, and with this construction the lower edges of the paper sheets and the like, temporarily stacked in the paper sheets and the like introducing space, are more effectively prevented from interfering with the subsequent paper sheets and the like, and a large number of paper sheets and the like can be introduced into the receiving cassette.

DETAILED DESCRIPTION OF THE PREFERRED EMBODIMENTS

Figure 13:
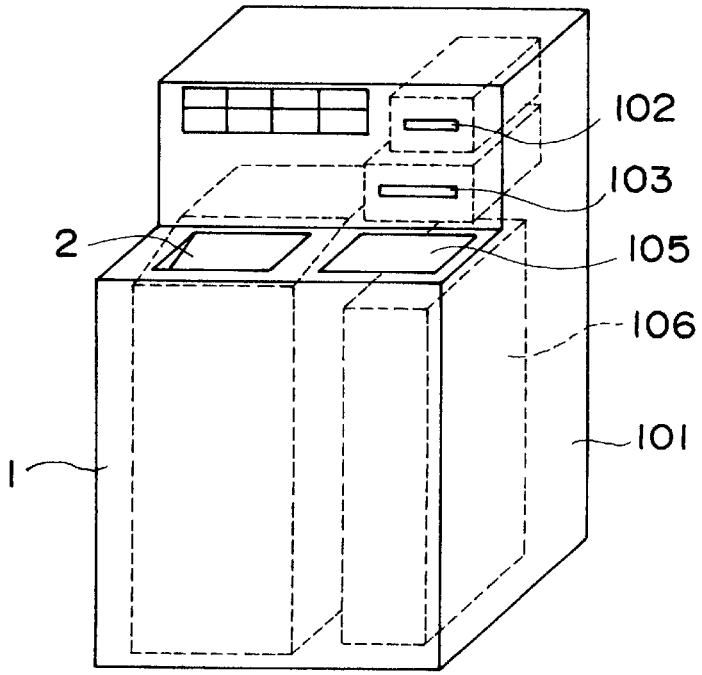
FIG. 13 is a view showing one embodiment of an automated teller machine of the invention.

A preferred embodiment of an automated teller machine of the present invention will now be described with reference to the drawings. FIG. 13 shows the automated teller machine 101 according to an embodiment of the present invention. The automated teller machine 101 includes, at its front side, a card insertion/discharge port 102, into which the user inserts a magnetic card for trade purposes and from which the card and a printed trade specification are discharged, a passbook insertion/discharge port 103, into which the user inserts a passbook for trade purposes and from which the passbook, having data (of the amount of entry and discharge money, the balance and so on) printed thereon, is discharged, a bill recycling module 1, having a cash slot assembly port 2 into which bills to be deposited are inserted by the user and from which bills to be paid to the user are discharged, an operating portion 105 (comprising a touch panel) which displays how to operate this operating portion, and enables the user to input contents of the trade which he is going to make, and a control portion for controlling the whole of the automated teller machine 101. Cash is directly put into and discharged from the automated teller machine by the operation of the user.

Figure 12:
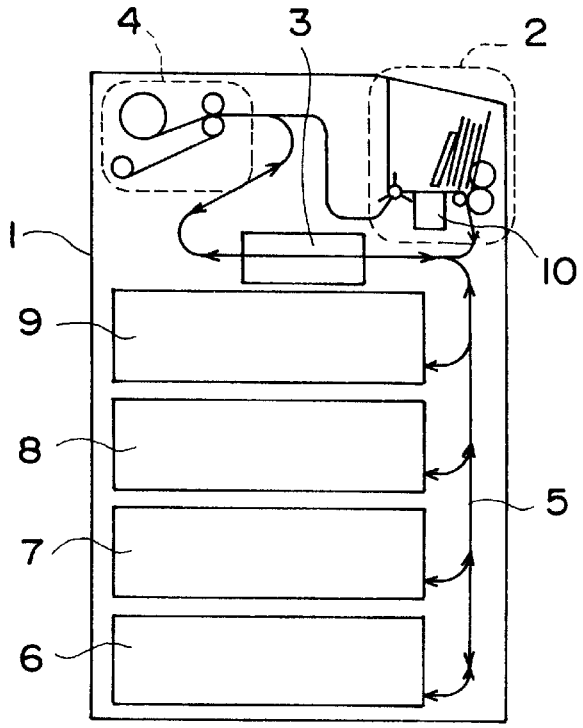
FIG. 12 is a side-elevational view of the construction of a preferred embodiment of a bill recycling module of the invention.

FIG. 12 is a side-elevational view showing the construction of the bill recycling module 1 of the automated teller machine of this embodiment shown in FIG. 13.

The bill recycling module 1 includes the cash slot assembly port 2, through which the bills are put into and out of the apparatus by the user, a bill validator 3 for discriminating between the bills, a temporary stacker 4 for once storing the entry bills until the trade is established, cash recycling box 6, 7 and 8 for storing the entry bills (for which the trade has been established) and discharge (outgoing) bills in accordance with the kinds of bills, an entry cash receiving cassette 9 for storing those of the entry bills, which are not used as discharge bills, and for storing those of the entry bills which can not be discriminated by the validator 3, a bill feeding path 5 for feeding the bills to the cash slot assembly port 2, the temporary stacker 4, the cash recycling boxes 6, 7 and 8 and the entry cash receiving cassette 9 via the bill validator 3, and the control portion (not shown).

The entry cash receiving cassette 9 and the cash recycling boxes 6, 7 and 8 are cassette-like receiving containers, respectively, and can be removed from the body of the bill recycling module 1 when replenishing and recovering bills.

A foreign matter box 10 is provided below the cash slot assembly port 2, and coins and others, inadvertently inserted, together with the entry bills, into this port 2, are separated from the bills, and are received in this box 10.

Next, the construction of the entry cash receiving cassette 9, provided in the paper sheets and the like handling apparatus 1 of this embodiment, will be described with reference to the drawings.

Figure 1:
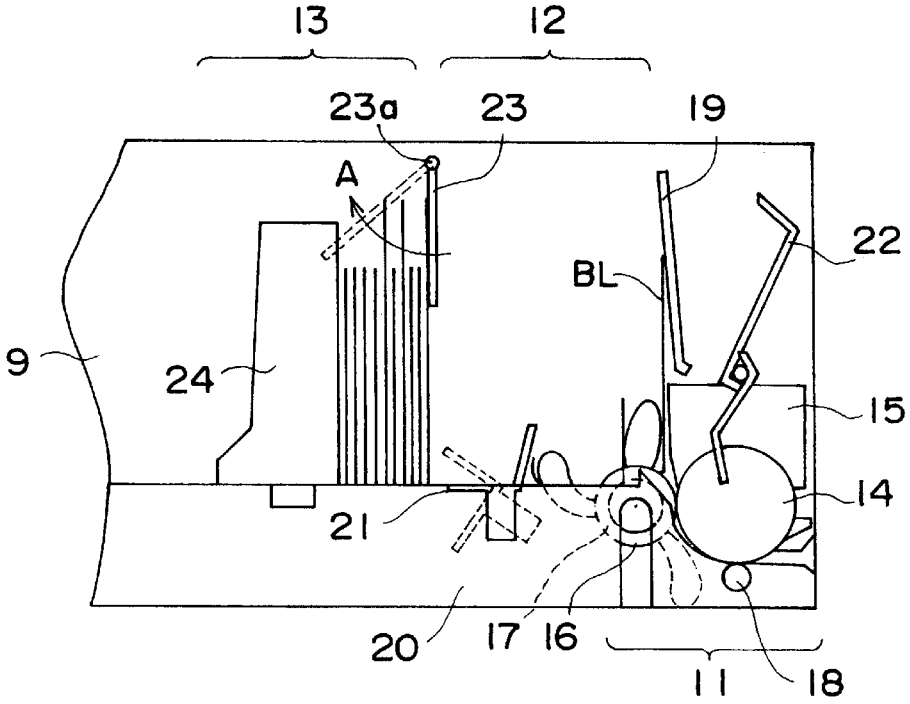
FIG. 1 is a transverse cross-sectional view of a preferred embodiment of a receiving cassette of the present invention.
Figure 2:
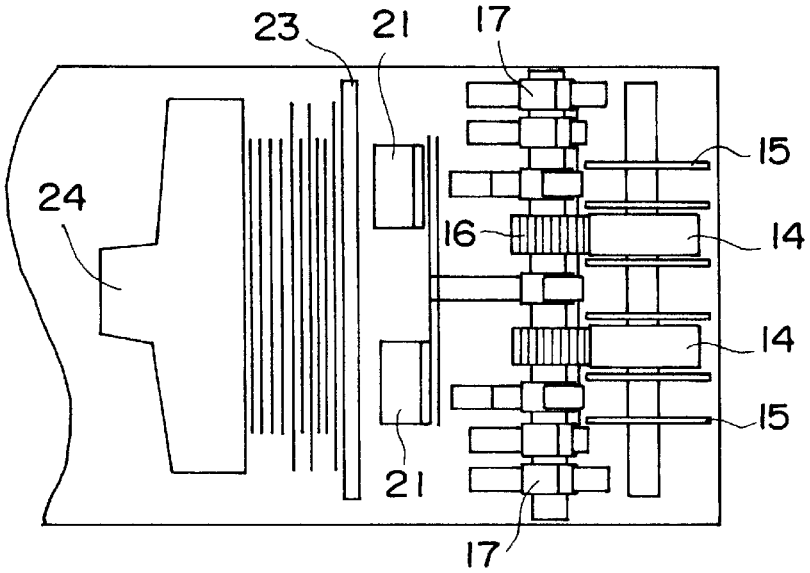
FIG. 2 is a top plan view of the receiving cassette.

FIG. 1 is a transverse cross-sectional view of the entry cash receiving cassette 9, and FIG. 2 is a top plan view thereof. The entry cash receiving cassette 9 comprises a bill introducing mechanism 11 (serving as bill introducing means), a bill introducing portion 12, a receiving space 13, and a bill receiving mechanism. In this embodiment, the entry cash receiving cassette can store a large number of (for example, 3,000) bills by increasing the dimension of the receiving space 13 in a storing direction.

The bill introducing mechanism 11 is a mechanism for introducing bills BL into the entry cash receiving cassette 9 from the exterior thereof, and this mechanism comprises receiving rollers 14, rotated by a drive source (not shown) via gears, abutment rollers 16 and 18, which are opposed to the receiving rollers 14, and cooperate with the receiving rollers 14 to feed the bill held therebetween, brush rollers 17, which are disposed on an axis, on which the abutment rollers 16 are disposed, and have brush portions, made of an elastic material, and are rotated by the drive source (not shown) independently of the abutment rollers 16, a plurality of lower receiving guides 15, which are spaced from one another in a direction of the axis of the receiving rollers 14, and guide the introduced bills, a guide 20, which forms bottom surfaces of the bill introducing portion 12 and receiving space 13 and a bill-introducing guide path, and guides the bills from the bill introducing mechanism to the receiving space, and an upper receiving guide 19 for guiding an upper edge of the introduced bill BL toward the introducing space 12.

The bill introducing portion 12 is a space formed by the guide 20, an upper partition plate 23, lower partition plates 21 and the upper receiving guide 19, and the bills, introduced by the bill introducing mechanism 11, are temporarily stored in this space.

The receiving space 13 is a space formed by the upper partition plate 23 and a press plate 24, and the bills, transferred to the entry cash receiving cassette 9, are finally stored in this space.

The bill receiving mechanism is a mechanism (serving as pushing means) for moving the bills, introduced and stored in the bill introducing portion 12, to the receiving space 13, and this mechanism comprises a push plate 22, which can be moved by a drive source (not shown), and the upper partition plate 23. The upper partition plate 23 can be rotated about an axis of a support shaft 23*a*, on which the upper partition plate 23 is supported, in a direction of arrow A, but can not be rotated toward the bill introducing portion 12. The support shaft 23*a* is connected to a drive belt, and the upper partition plate 23 is rotated in accordance with the movement of the push plate 22.

The distance between the lower end of the upper partition plate 23 and the bottom surface of the guide 20 is smaller than the shorter side of minimum-size bills which are to be handled by the bill handling apparatus 1. The width of the upper partition plate 23 in the direction of the axis of the roller shaft is generally equal to the width of the bill introducing portion 12 and receiving space 13.

For introducing a large number of bills into the bill introducing portion 12, it is desirable to increase the size of the bill introducing portion 12. However, if the size of the bill introducing portion 12 is excessively increased, the number of bills to be stored in the receiving space 13 would be limited. In order that the bill can be gripped by (or held between) the brush portions of the brush rollers 17 and the lower partition plates 21 projecting from the bottom surface of the bill introducing portion 12, the distal ends of the brush portions need to contact the lower partition plates 21 as will be described later. In addition, the lower partition plates 21 need to be provided at such a position that minimum-size bills to be handled will not fall toward the bill introducing portion 12, and can be held in an upstanding condition. Therefore, the position of the lower partition plates 21 is determined by the length of the brush portions of the brush rollers 17 and the sizes of bills to be handled.

When introducing a small number of bills into the bill introducing portion 12, the bills are gripped by the brush portions of the brush rollers 17 and the lower partition plates 21 in an upstanding condition.

On the other hand, when introducing a large number of bills, first, the bills to be introduced into the bill introducing portion 12 are gripped by the brush portions of the brush rollers 17 and the lower partition plates 21 as described above for storing a small number of bills, and are introduced into the bill introducing portion 12 in an upstanding condition. However, when the number of bills to be introduced is large, the distance between each lower partition plate 21 and the brush rollers 17 is, in some cases, not large enough to allow the bills to be introduced between the lower partition plate 21 and the brush rollers 17.

Therefore, the lower partition plates 21 are of such a construction that these plate 21 can be rotated toward the receiving space 13. And, when a large number of bills are introduced, the lower partition plates 21 are rotated, and by doing so, the bills can be introduced into the bill introducing portion 12. At this time, the brush portions grip newly-introduced bills in cooperation not with the lower partition plates 21 but with the bills which have already been introduced in an upstanding condition in a sufficient amount that the bills will not fall toward the receiving space 13 even upon application of pressures from the brush portions.

Therefore, the lower partition plates 21 are disposed closer to the bill introducing portion 12 than the upper partition plate 23 is, and each lower partition plate 21 has its rotation axis disposed below the bottom surface of the guide 20, and is normally held in a position, indicated in a solid line in FIG. 1, by a spring. The lower partition plate 21 can not be rotated beyond this position toward the bill introducing portion 12, but can be rotated toward the receiving space 13.

The lower partition plate 21 is inclined at its end portion toward the bill introducing mechanism 11. The lower partition plate 21 may be inclined toward the bill introducing mechanism 11 over a region extending from its lower end to its upper end as shown in the drawings, but may be inclined only at its distal end portion. The height of the lower partition plate 21 is smaller than the height of minimum-size bills to be handled.

In this embodiment, there are provided the two lower partition plates 21 which are spaced from each other in the direction of the width of the entry cash receiving cassette 9, that is, in the direction of the axis of the brush rollers 17, and can be rotated independently of each other, and can deal with bills of various shapes such as a curled or folded bill. The lower partition plate 21 is provided at a position spaced from the position, where bills are introduced into the entry cash receiving cassette 9 by the bill introducing mechanism 11, by a distance smaller than the shorter side of minimum-size bills to be handled by the bill recycling module 1, and with this construction, bills can be held in an upstanding condition within the bill introducing portion 12. When the brush roll 17 is rotated through a predetermined angle, the brush portion of the brush roller 17 is disposed in the vicinity of the lower partition plate 21 so that the bill can be held between the lower partition plate 21 and this brush portion.

During the transfer of bills to the bill introducing portion 12, the upper partition plate 23 and the lower partition plates 21 serve as walls separating the bill introducing portion 12 from the receiving portion 13, and bills in the receiving space 13 will not interfere with bills being transferred to the bill introducing portion 12.

Figure 3:
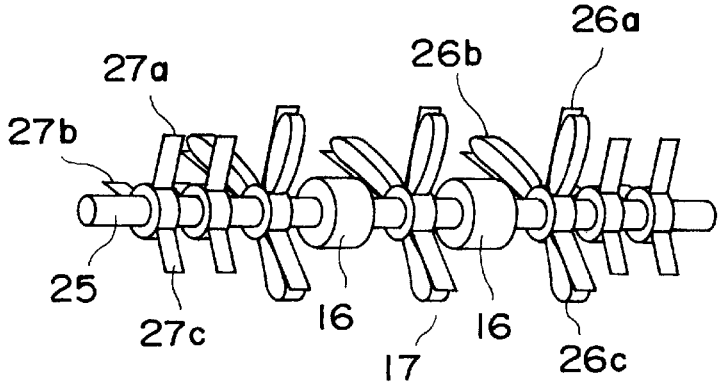
FIG. 3 is a perspective view of brush rollers of the receiving cassette.

FIG. 3 is a perspective view showing the abutment rollers 16 and the brush rollers 17 which are disposed on the common axis.

In this embodiment, the two abutment rollers 16 are mounted on an axially-central portion of a metal shaft 25, and are spaced a predetermined distance from each other. Each abutment roller 16 can rotate independently of the metal shaft 25, for example, through a bearing (not shown) interposed between this roller and the metal shaft 25. The plurality of brush rollers 17 are mounted on the metal shaft 25, and are spaced from one another in the axial direction. Brushes of the brush roller 17 extend radially of the metal shaft 25, and are circumferentially spaced at equal intervals. Two kinds of brushes, that is, loop-like brushes and sheet-like brushes, are provided. The brush rollers 17, each comprising the brushes 26*a*, 26*b* and 26*c* each comprising a pair of loop-like and sheet-like members, are mounted on the axially-central portion of the metal shaft 25, and the brush rollers 17, each comprising the brushes 27*a*, 27*b* and 27*c* each comprising a sheet-like member, are mounted on opposite end portions of the meta shaft 25.

The shape of the brushes is determined by their rigidity and friction coefficient. In this embodiment, although the loop-like brushes and the sheet-like brushes are used as described above, the shape and material of the brushes are not limited to those of this embodiment in so far as the necessary rigidity and friction coefficient are satisfied.

Figure 4:
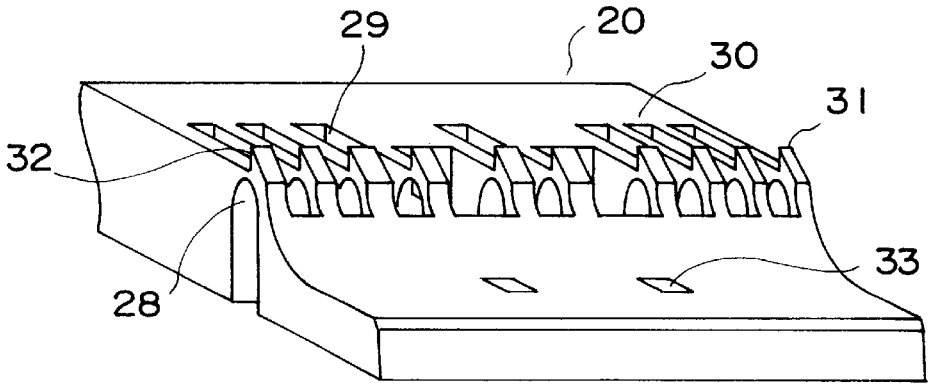
FIG. 4 is a perspective view of a guide of the receiving cassette.

FIG. 4 is a perspective view of the guide 20. The guide 20 serves to guide bills, which are to be introduced into the entry cash receiving cassette, and also serves to support the lower edges of the bills in the bill introducing portion 12 and the receiving space 13. The brush rollers 17 and the abutment rollers 16 are fitted into a groove 28 from the lower side of this guide 20. A plurality of notches 29, in which these rollers are fitted, are formed in the guide 20. The size of each notch 29 is smaller than the length of the brushes 26*a*, 26*b* and 26*c* so that these brushes can partially project from the bottom surface 30 of the guide 20 when the brush roller rotates. At the bill introducing space region, the bottom surface 30 of the guide 20 is stepped as at 32 with respect to an apex 31 of the bill-introducing guide path to be disposed at a level lower than this apex 31. The guide 20 has holes 33 in which the two abutment rollers 18 are fitted, respectively. The function of this step portion 32 will be described later.

Next, the operation for introducing bills into the entry cash receiving cassette 9 will be described with reference to FIGS. 1 and 5 to 7.

For introducing bills into the entry cash receiving cassette 9, the bill is fed between the receiving rollers 14 and the abutment rollers 16 from the bill transfer path 5. Then, the bill is inserted between the lower receiving guides 15 and the brush rollers 17 which are kept stationary in staggered relation to these lower receiving guides 15, and the bill is fed while subjected to a frictional resistance, and the when the gripping transfer force, produced by the receiving rollers 14 and the abutment rollers 16, ceases to act on the bill, the bill is gripped by (held between) the lower receiving guides 15 and the brushes, and is once stopped at a position indicated by BL in FIG. 1.

Figure 5:
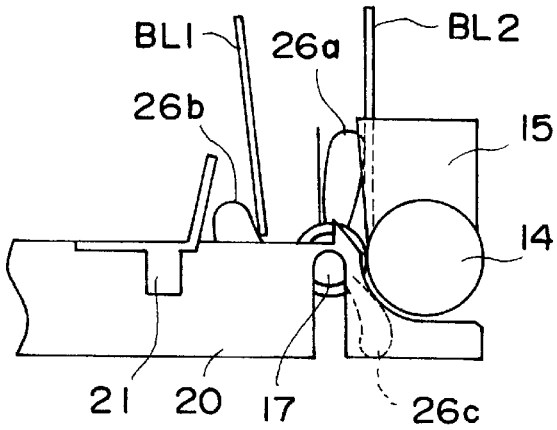
FIG. 5 a view explanatory of a bill-introducing operation.

Then, when a second bill BL2 to be introduced into the entry cash receiving cassette 9 passes past a predetermined position of the bill feeding path 5 or bill introducing mechanism 11, this passage is detected by a sensor (not shown), and the brush rollers 17 are rotated in a predetermined amount, thereby canceling the application of the frictional resistance, and the bill BL1, gripped by the lower receiving guides 15 and the brushes 26*b*, is moved toward the introducing space 12, as shown in FIG. 5. After the brush rollers 17 are rotated in the predetermined amount, the brushes 26*a* of the brush rollers are stopped in a rotational position where these brushes are in contact with the receiving guides or in a rotational position where the brushes overlap the receiving guides, in preparation for the subsequent bill BL2. The amount of rotation of the brush rollers 17 is not limited to a specified value, but in the construction of this embodiment in which each brush roller 17 has the three brushes, this rotation amount is set to 120° so that the subsequent brushes 26*b* for braking purposes can overlap the receiving guides.

At this time, the brushes 26*b*, which together with the lower receiving guides 15, have gripped the bill BL1, project from the bottom surface 30 of the guide 20, and are stopped in the vicinity of the lower partition plates 21. Therefore, the first bill BL1, first fed to the bill introducing portion 12, is stored in an upstanding posture between the brushes 26*b* and the brushes 26*a* gripping the subsequent bill BL2.

Figure 6:
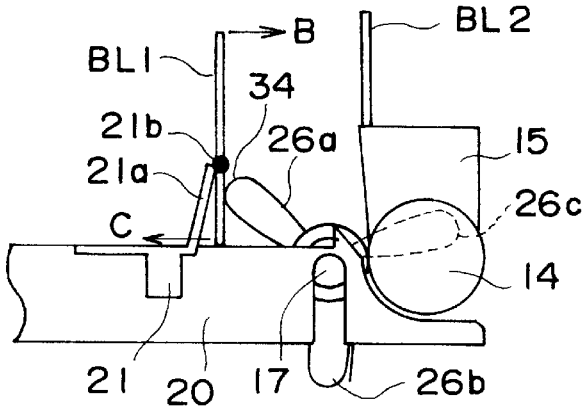
FIG. 6 is a view explanatory of the bill-introducing operation.
Figure 7:
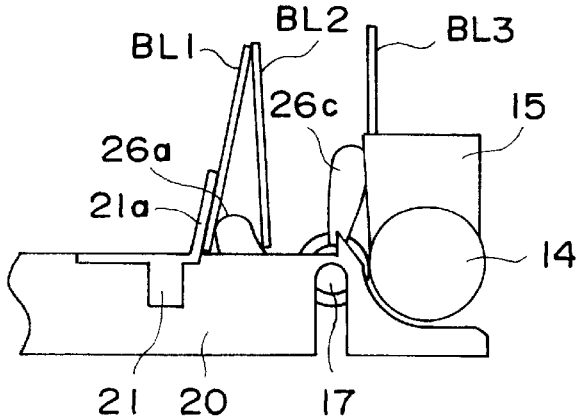
FIG. 7 is a view explanatory of the bill-introducing operation.

Then, when a third bill BL3, which is to be subsequently fed to the cash entry receiving cassette 9, passes past the above predetermined position, the brush rollers 17 are rotated, so that the brushes 26*a* are brought into contact with the first bill BL1, stored in the bill introducing portion 12, and push this bill into engagement with a bill abutment surface portion of each lower partition plate 21, as shown in FIG. 6. At this time, the upper end portion of the abutment surface portion 21*a* of the lower partition plate 21 is inclined toward the bill introducing space, and a point (force-applying point) 34 of pressing contact of the brush 26*a* with the bill BL1 is closer to the bottom surface 30 of the guide 20 than the upper end 21*b* of the bill abutment surface portion 21*a* is, and therefore the bill BL1 is pivotally moved about the upper end 21*b* of the bill abutment surface portion 21*a* in such a manner that the upper edge of this bill BL1 is moved in a direction of arrow B (FIG. 6) while the lower edge of the bill BL1 is moved in a direction of arrow C. As a result, the bill BL1 is held between (gripped by) each lower partition plate 21 and the brush 26*a* in such a manner that this bill is disposed in intimate contact with the entire surface of the bill abutment surface portion 21*a* in an inclined upstanding posture.

At this time, in the same manner described above for the first bill BL1, the secondly-introduced bill BL2 is fed to the introducing space 12 by the brushes 26*c*, and is stored in an upstanding posture between the projecting brushes 26*a* and the brushes 26*c* gripping the subsequent bill BL3. The third bill BL3 is held between the brushes 26*c* and the lower receiving guides 15, and is stopped in this condition.

When a fourth (or other subsequent) bill is to be introduced, the brush rollers are rotated, and the brushes 26*a* pass through the respective notches 29, so that the gripping of the first bill BL1 is once canceled, but this first bill BL1 is again, together with the bill BL2, gripped by the brushes 26*c*.

The bills are held (gripped) in the inclined upstanding posture within the bill introducing portion 12, and therefore the bills are more effectively prevented from interfering with the subsequent bill which is being introduced into the entry cash receiving cassette 9 from the lower side thereof by the bill introducing mechanism 11.

Namely, the interference of the bill, being introduced from the lower side, with the bills, gripped in the upstanding posture, occurs upon contact of the lower edges of the gripped bills with the bill being introduced, and therefore for spacing the lower edges of the gripped bills farther from the bill introducing port, it is more effective to grip the bills in an inclined upstanding posture.

As described above, the brush rollers 17 of this embodiment have part of the function of the introducing means, in which the brush rollers cooperate with the lower receiving guides 15 to hold the bill therebetween when introducing the bill into the entry cash receiving cassette 9, the function of the feed means for feeding the introduced bill to the bill introducing portion 12 and for storing (stacking) these bills in the upstanding posture, and the function of the gripping means in which the brush rollers cooperate with the lower partition plates 21 to grip the bills introduced into the bill introducing portion 12.

Figure 8:
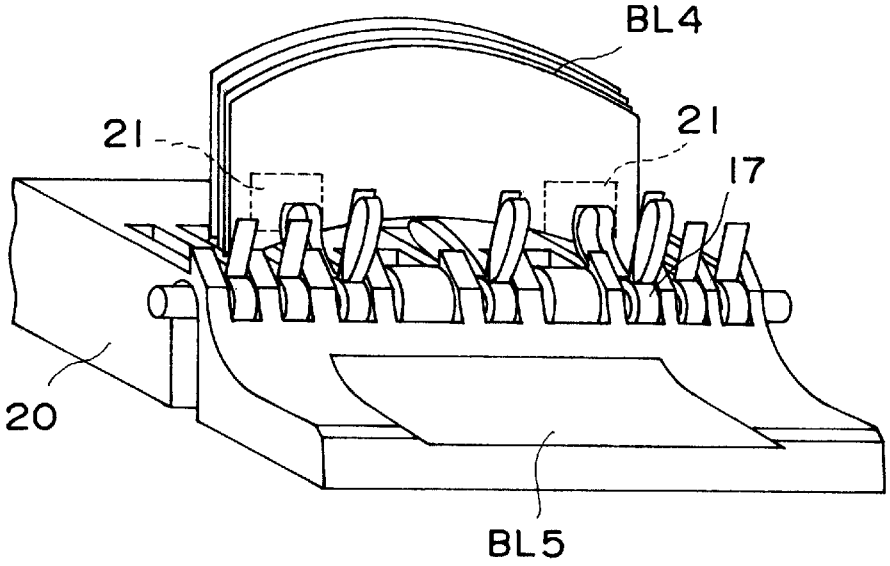
FIG. 8 is a perspective view showing a condition in which curled bills are introduced into the receiving cassette.

Therefore, even when bills BL4, having their right and left end portions curled toward the bill introducing mechanism 11, are introduced as shown in FIG. 8, lower end portions of the bills BL4 are held between (gripped by) the brushes and the lower partition plates 21 in the introducing space 12, and are kept in an upstanding posture in the bill introducing portion 12, and therefore these bills BL4 are prevented from interfering with a subsequently-introduced bill BL5 in the introducing space 12.

Figure 9:
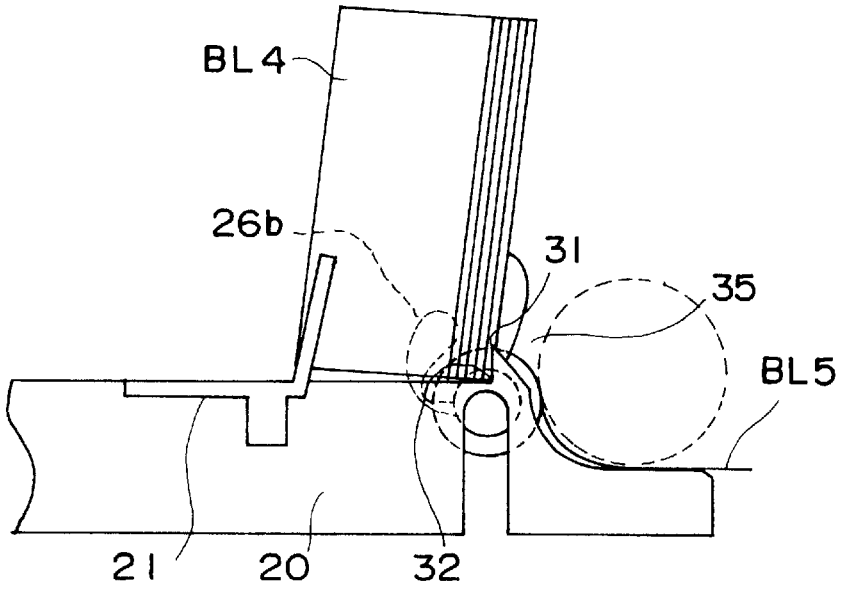
FIG. 9 is a perspective view showing a condition in which the curled bills are introduced into the receiving cassette.

When a large number of curled bills are introduced, the rigidity of the brushes 26*b*, in some cases, can not withstand the restoring force of the stack of curled bills BL4 pressing the brushes, so that the brushes are much deformed, as shown in FIG. 9. As a result, the brushes 26*b* are much deformed toward the bill-pushing position, which results in a possibility that the stack of curled bills BL4 are not held between the lower partition plates 21 and the brushes 26*b*.

In this case, when the right and left end portions of the curled bills reach the bill-introducing guide path 35 along which bills to be introduced are fed, the curled bills BL4, in some cases, project into the bill-introducing guide path 35 through the space between the adjacent brushes, and interfere with the bill BL5, fed to the bill-introducing guide path, thereby causing the residence of the bill, and as a result the trade is stopped.

Therefore, projection prevention means is provided for preventing the end portions of the bills, introduced into the bill introducing portion 12, from projecting into the bill-introducing guide path 35.

In this embodiment, the projection prevention means is provided by the step portion 32 which is formed on the guide 20 of the bill introducing portion 12, and is disposed at a level lower than the apex 31 of the bill-introducing guide path 35. Thanks to the provision of this step portion 32, the right and left end portions of the curled bills BL4 are prevented from projecting into the bill-introducing guide path 35. Such a step portion may be formed by providing a protected portion.

Of course, even if the bill, which can not be gripped by the lower partition plate 21 and the brushes immediately after it is pushed out, is curled, the step portion 32 of the guide 20 serves as a prevention wall, and therefore can prevent the projection of this bill.

Thus, the bills are introduced one by one in such a manner that their lower edges are arranged neatly, and the lower end portions of the introduced bills are gripped by the gripping members, or the introducing space 12 is separated from the introducing transfer path by the step portion 32, and by doing so, even those bills of different sizes, tending to be folded or curled, can be properly stacked in an upstanding posture in a limited small space.

Figure 10:
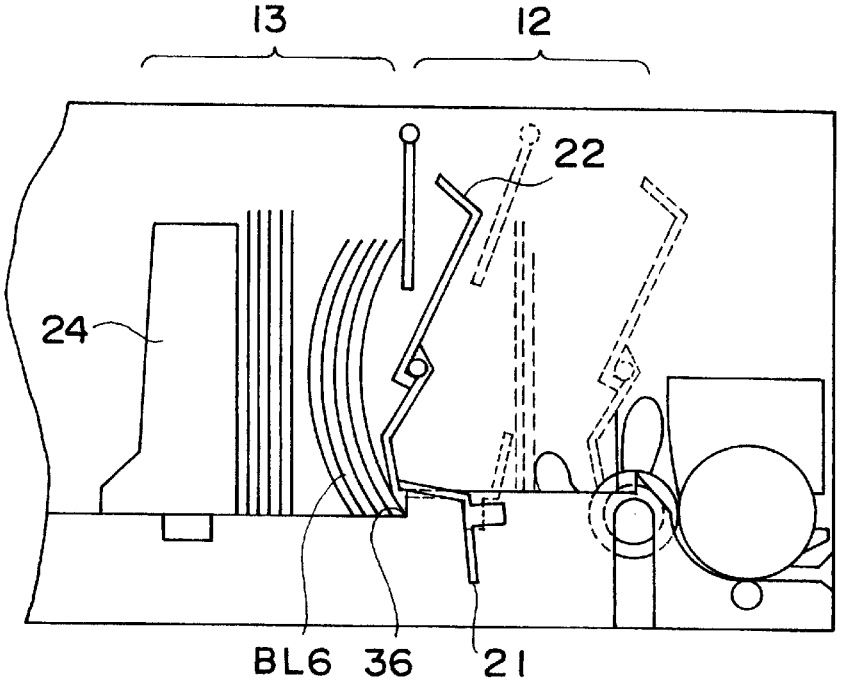
FIG. 10 is a view explanatory of a storing operation.

In this embodiment, the gripping members also serve as the members (brushes) for feeding the bills, and therefore the cost can be reduced. Of course, even when gripping members for performing the gripping function are provided separately from such brushes, there is no problem from a functional point of view, Next, the operation for transferring the bills from the bill introducing portion 12 to the receiving space 13 will be described with reference to FIG. 10.

When the introduction of the bills (which are to be stored in the receiving space 13) into the bill introducing portion 12 is finished, a drive belt (not shown) is driven to advance the push plate 22 toward the receiving space 13. When the push plate 22 advances to a position where it contacts the stack of bills to support the same, the upper partition plate 23 begins to be retracted toward the bill introducing portion 12 in synchronism with the push plate 22.

When the push plate 22 further advances to push the stack of bills toward the receiving space 13, the stack of bills gradually rotates the upper partition plate 23 and the lower partition plates 21 toward the receiving space 13, and the push plate 22 moves while pushing the press plate 24 in the receiving space 24 and the bills BL6.

When the push plate 22 further advances into the receiving space 13, the upper partition plate 23 is disengaged from the upper edges of the bills BL6 while the lower partition plates 21 are disengaged from the lower end portions of the bills BL6, so that the upper partition plate 23 and the lower partition plates 21 are returned to their respective initial positions, and the bills BL6 are stored in the receiving space 13.

A step portion 36 (serving as projection prevention means) is provided at the boundary between the receiving space 13 and the guide 20 of the bill introducing portion 12, so that the bottom surface of the receiving space 13 is disposed at a level lower than the bottom surface of the introducing space 12. With this construction, the stored bills, tending to be folded or curled, are prevented from projecting into the introducing space 12. If the stored bills BL6 project as far as the lower partition plates 21, the lower partition plates 21 are prevented from being rotated by the bills, pressed against these plates 21, when the bills are introduced in a large amount into the introducing space 12, and the introducing space 12 is kept narrow, so that the number of bills to be introduced thereinto is limited. The provision of the step portion 36 overcomes this disadvantage.

Although this embodiment is directed to the receiving cassette, the invention can be applied to the cash entry/discharge port 2 in which discharge bills are stacked. Description will be made of an example in which the invention is applied to the cash entry/discharge port 2. Means, performing the same functions as those used in the receiving cassette, will be designated by the same names, respectively.

Figure 11:
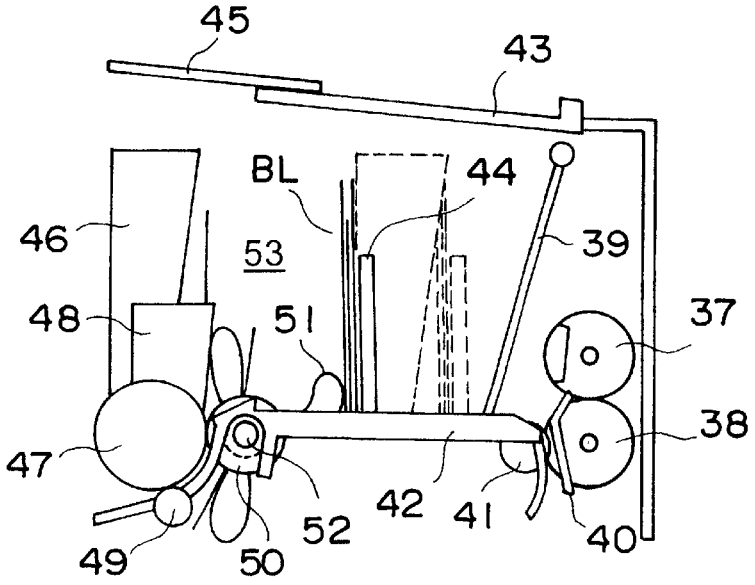
FIG. 11 is a transverse cross-sectional view of a cash slot assembly port according to embodiment of the present invention.

FIG. 11 shows the construction of the cash entry/discharge port 2. A shutter 43, which is opened and closed when putting bills into and out of the apparatus, is provided at an upper portion of the cash entry/discharge port 2. Constituent members for separating entry bills from one another are provided at a lower portion of the cash entry/discharge port 2, and these constituent member include separation rollers 37, gate rollers 41, transfer rollers 38, and separate guides 40. There are provided a front plate 39 and a partition plate 44 which presses the bill when separating the bills.

Constituent members for stacking the discharge bills include receiving rollers 47, rotated by drive means (not shown), abutment rollers 49 and 52, held against the receiving rollers 47 so as to be driven, a plurality of brush rollers 50, which are disposed on an axis, on which the abutment rollers 52 are disposed, and are spaced from one another in the axial direction, and are intermittently driven by driven means (not shown) independently, receiving guides 48, which are opposed to the brush rollers 50 in overlapping relation thereto, an introducing space 53 into which bills BL are introduced while being guided by the receiving guides 48, abutment rollers 49 for transferring the bills to the cash entry/discharge port 2, a guide 42 which guides the transferred bills, and serves as a stack surface for the bills, the partition plate 44 which forms, together with the receiving guides 48, the introducing space 53, and a top plate 45 provided at an upper portion of the introducing space 53.

An operation for introducing the bills is the same as described above for the receiving cassette, and therefore explanation thereof will be omitted. The partition plate 44 serves also to feed entry bills toward the front plate 39, and therefore can be moved by drive means (not shown), and when discharging bills, this partition plate 44 is moved to a position where brushes 51 of the brush rollers 50 contact it. As described above for the above embodiment, the bills BL, fed to the introducing space 53, are stacked while gripped at their lower end portions by the partition plate 44 and the brushes 51. Therefore, even lower edges of bills of different sizes are arranged nearly on the surface of the guide 42, and therefore the bills can be gripped, and a large number of bills can be stacked in a limited small space. When the stacking operation is finished, a push plate 46, provided at the rear side of the receiving guides 48, moves to the introducing space 53, and cooperates with the partition plate 44 to hold the bills BL therebetween, and in this condition the push plate 46 and the partition plate 44 move while gripping the bills BL, and then are stopped when the brushes 51 of the brush rollers are disengaged from the partition plate and the stacked bills, and the shutter 43 is opened, and after the operator takes all of these bills out of the cash entry/discharge port, the shutter 43 is closed, thus completing the cash-discharging operation.

As described above, in the embodiments of the present invention, a large number of bills of different sizes, tending to be folded or curled, can be positively stacked in an upstanding posture with the simple construction.

In the present invention, there can be provided the paper sheets and the like handling apparatus in which even when paper sheets and the like of different sizes, as well as paper sheets and the like tending to be folded or curled, are introduced in a large amount into the paper sheets and the like handling apparatus, these paper sheets and the like can be positively stored in an upstanding posture in a small space within the paper sheets and the like receiving cassette or the entry/discharge port (inlet/outlet port), and the receiving cassette or the entry/discharge port is highly-reliable and inexpensive, and is less liable to troubles such as residence of the paper sheets and the like.

What is claimed is:

1. A paper sheets handling apparatus comprising a receiving cassette for storing paper sheets in an upstanding posture;

wherein said receiving cassette includes a paper sheets introducing mechanism for introducing the paper sheets into said receiving cassette from a lower side thereof, and a paper sheets introducing portion for gripping the paper sheets introduced into said receiving cassette by said paper sheets introducing mechanism, in an upstanding posture so as to stack the paper sheets;

wherein said paper sheets introducing mechanism comprises:

a receiving guide for guiding the paper sheets to be introduced into said receiving cassette, said receiving guide being provided at that side of a paper sheets introducing port facing away from said paper sheets introducing portion; and brush rollers which cooperates with said receiving guide to hold the paper sheets to be introduced into said receiving cassette, said brush roller being provided at that side of paper sheets introducing port facing said paper sheets introducing portion, and each of said brush rollers having a plurality of radially-extending brush portions; and wherein said paper sheets introducing portion includes a partition projecting from a bottom surface of said paper sheets introducing portion, and said partition is provided at a position where distal ends of said brush portions can contact said partition, and said partition is moveable away from said brush portions when said paper sheets are to be moved out of said paper sheets introducing portion.

2. An apparatus according to claim 1, in which an upper end portion of said partition is slanting toward said paper sheets introducing mechanism.

3. An apparatus according to claim 1, in which the paper sheets introduced into said receiving cassette are held between said brush portions and said receiving guide, and then are rotated, and said brush portions, together with a partition plate, hold the paper sheets, introduced into said paper sheets introducing portion before the introduction of said first-mentioned paper sheets into said paper sheets introducing portion, in an upstanding posture, and the rotation of said brush rollers is so controlled that the one of said plurality of brush portions of each of said brush rollers, disposed at a downstream side in the direction of rotation of said brush roller, can cooperate with said receiving guide to grip subsequent paper sheets.

4. An apparatus according to claim 1, in which said receiving cassette comprises:

push means for moving the paper sheets introduced into said paper sheets introducing portions, into a receiving space which can store the paper sheets; and means for preventing the paper sheets stored in said receiving space, the paper sheets introduced into said paper sheets introducing portion, and the paper sheets introduced by said paper sheets introducing mechanism, from interfering with each other.

5. An apparatus according to claim 1, in which said receiving cassette is a paper sheets inlet/outlet port through which the paper sheets are put into and out of said apparatus.

6. An apparatus according to claim 1, comprising a step barrier between said paper sheets introducing mechanism and said paper sheets introducing portion, to block and prevent curling portions of said paper sheets within said paper sheets introducing portion from interfering with a paper sheet handling within said paper sheets introducing mechanism.

7. An apparatus according to claim 1, comprising:

push means for moving the paper sheets introduced into said paper sheets introducing portion into a receiving space which can store the paper sheets; and, a step barrier between said paper sheets introducing portion and said receiving space, to block and prevent curling portions of said paper sheets within said receiving space from interfering with a paper sheet handling within said paper sheets introducing portion.

8. A paper sheets handling apparatus, comprising a receiving cassette for storing paper sheets in an upstanding posture;

wherein said receiving cassette includes a paper sheets introducing mechanism for introducing the paper sheets into said receiving cassette from a lower side thereof, a paper sheets introducing portion for gripping the paper sheets in an upstanding posture so as to stack the paper sheets, and feed means for feeding the paper sheets introduced by said paper sheets introducing mechanism, to said paper sheets introducing portion; and wherein said paper sheets introducing mechanism includes gripping means provided in the vicinity of a paper sheets introducing port, and said gripping means includes a plurality of brush portions which grip the paper sheets to be introduced into said receiving cassette, and feeds said paper sheets to said paper sheets introducing portion, and said brush portions grip the paper sheets against a partition in and upstanding posture in said paper sheets introducing portion, comprising a step barrier between said paper sheets introducing mechanism and said paper sheets introducing portion, to block and prevent curling portions of said paper sheets within said paper sheets introducing portion from interfering with a paper sheet handling within said paper sheets introducing mechanism.

9. A paper sheets handling apparatus, comprising a receiving cassette for storing paper sheets in an upstanding posture;

wherein said receiving cassette includes a paper sheets introducing mechanism for introducing the paper sheets into said receiving cassette from a lower side thereof, a paper sheets introducing portion for gripping the paper sheets in an upstanding posture so as to stack the paper sheets, and feed means for feeding the paper sheets introduced by said paper sheets introducing mechanism, to said paper sheets introducing portion; and wherein said paper sheets introducing mechanism includes gripping means provided in the vicinity of a paper sheets introducing port, and said gripping means includes a plurality of brush portions which grip the paper sheets to be introduced into said receiving cassette, and feeds said paper sheets to said paper sheets introducing portion, and said brush portions grip the paper sheets against a partition in an upstanding posture in said paper sheets introducing portion, comprising push means for moving the paper sheets introduced into said paper sheets introducing portion into a receiving space which can store the paper sheets; and, a step barrier between said paper sheets introducing portion and said receiving space, to block and prevent curling portions of said paper sheets within said receiving space from interfering with a paper sheet handling within said paper sheets introducing portion.

10. A paper sheets handling apparatus, comprising a receiving cassette for storing paper sheets in an upstanding posture;

wherein said receiving cassette includes a paper sheets introducing mechanism for introducing the paper sheets into said receiving cassette from a lower side thereof, a paper sheets introducing portion for gripping the paper sheets in an upstanding posture so as to stack the paper sheets, and feed means for feeding the paper sheets introduced by said paper sheets introducing mechanism, to said paper sheets introducing portion; and wherein said paper sheets introducing mechanism includes gripping means provided in the vicinity of a paper sheets introducing port, and said gripping means includes a plurality of brush portions which grip the paper sheets to be introduced into said receiving cassette, and feeds said paper sheets to said paper sheets introducing portion, and said brush portions grip the paper sheets against a partition in an upstanding posture in said paper sheets introducing portion, in which an upper end portion of said partition is slanting toward said paper sheets introducing mechanism.

* * * * *